US007081024B2

(12) United States Patent
Karadimas et al.

(10) Patent No.: US 7,081,024 B2
(45) Date of Patent: Jul. 25, 2006

(54) ELECTRICAL CONNECTOR SYSTEM AND METHOD INVOLVING POSITIVE MATING AND FLEX RELEASE

(75) Inventors: Margaret Karadimas, Naperville, IL (US); Andrew Hottel, Bartlett, IL (US); Thomas Pravongviengkham, Sr., Elgin, IL (US)

(73) Assignee: GENSUS, Schenectady, NY (US)

( * ) Notice: Subject to any disclaimer, the term of this patent is extended or adjusted under 35 U.S.C. 154(b) by 0 days.

(21) Appl. No.: 10/930,751

(22) Filed: Sep. 1, 2004

(65) Prior Publication Data

US 2006/0046578 A1 Mar. 2, 2006

(51) Int. Cl.
*H01R 13/64* (2006.01)

(52) U.S. Cl. ..... 439/680; 439/180

(58) Field of Classification Search ..... 439/700, 439/680, 180, 677
See application file for complete search history.

(56) References Cited

U.S. PATENT DOCUMENTS 2,419,018 A * 4/1947 Gudie ..... 439/744
2,933,711 A * 4/1960 Eaton ..... 439/316
4,229,064 A * 10/1980 Vetter et al. ..... 439/680
4,443,052 A * 4/1984 Eaby et al. ..... 439/322
4,795,359 A * 1/1989 Alcock et al. ..... 439/271
4,927,374 A * 5/1990 Batty ..... 439/310
6,878,016 B1 * 4/2005 Wulff et al. ..... 439/700
6,910,911 B1 * 6/2005 Mellott et al. ..... 439/358

* cited by examiner

*Primary Examiner*—Michael C. Zarroli
(74) *Attorney, Agent, or Firm*—Baker & Hostetler LLP

(57) ABSTRACT

A system and method for providing an electrical and mechanical connection. The electrical connector includes a plug having a housing, a key attached to the housing, the key is configured to mate with a key slot located on a mating receptor, a groove running along an outer periphery of the housing and configured to communicate with a plurality of receivers that are located in a circular discontinuous manner on the mating receptor, the plurality of receivers comprise a ridge that mates with the groove, a first electrical contact attached to the housing and a second electrical contact attached to the housing on a side opposite the first electrical contact and in electrical communication with the first electrical contact.

18 Claims, 3 Drawing Sheets

ELECTRICAL CONNECTOR SYSTEM AND METHOD INVOLVING POSITIVE MATING AND FLEX RELEASE

FIELD OF THE INVENTION

The present invention relates generally to electrical connectors. More particularly, the present invention relates to an connector system and method connecting an electrical plug and a receptacle.

BACKGROUND OF THE INVENTION

Nurses in hospitals can be very busy and responsible for a large amount of patients at one time. In order to enable nurses to quickly identify particular needs of an individual patient, nurse call and alert systems have been developed. For example, a patient having a problem or needing the attention of a nurse can activate an actuator located in the patient's room and it will indicate to the nurses located at a central nurses station that a patient is requesting assistance. In other systems, electronic medical devices that monitor and/or treat patients can have alarms when patient's vital signs or treatment schedule is outside a predetermined parameter. In such cases, these machines can send a signal to a nurses station alerting the nurse of the problem.

Many of these nurse call systems include cables or wires running from the patient's room to the nurses station and connect to a terminal unit at the nurses station. A connector system and method may be used in order to connect the cable running from the patient's room to the terminal located at the nurses station.

Connector systems often connect a cable with another cable or with a terminal unit by making both an electric and mechanical connection. Desirable features of an electrical connection include positive contact between the electrical portions in each side of the connector in order to provide a reliable electronic connection. Desirable features associated with mechanical connection include a mechanical connection strong enough so that the connectors will not come apart if they are knocked or jostled in everyday use.

In addition, it may be desirable to permit the connectors to separate if a force acting to separate the connecting reaches a predetermined level. Ideally, separation will not damage the connectors, and they can be repeatedly connected and separated. Further, it may be desirable for some electrical connections to mechanically permit the connectors to only come together in certain predetermined attitudes with respect to each other to ensure the proper electrical leads contact corresponding electrical leads in the connection.

Accordingly, it is desirable to provide a system and method for making both an electric and mechanical connection between the cable and the terminal unit that ensures a positive electrical contact and keeps the connectors together so they do not easily come apart during normal jostling or everyday use. Further, in some applications it may desirable to provide a connection that mechanically can only be connected with the connectors approaching each other in a single attitude in order to assure proper electrical leads match up with the corresponding leads on the other side of the connection.

SUMMARY OF THE INVENTION

The foregoing needs are met, to a great extent, by the present invention, wherein in one aspect an apparatus is provided that in some embodiments provides an electrical and mechanical connection between a cable and a terminal unit creating a positive electrical connection. In some embodiments the connection creates a mechanical connection strong enough to avoid the connectors from separating during everyday use. Some embodiments provide an electrical connection that can come together in only one attitude with respect to each other to ensure that the proper electrical leads connect only to corresponding electrical leads on the other side of the connection.

In accordance with one embodiment of the present invention, an electrical connector is provided. The electrical connector includes:a plug having a housing; a key attached to the housing; a ridge running along an outer periphery of the housing and configured to communicate with a corresponding groove in a mating receptor; a first electrical contact attached to the housing; and a second electrical contact attached to the housing on a side opposite the first electrical contact and in electrical communication with the first electrical contact.

In accordance with another embodiment of the present invention, an electrical connector is provided. The electrical connector includes: means for housing; means for aligning attached to the housing means;a locking means running along an outer periphery of the housing means and configured to communicate with a corresponding structure in a mating receptor; a first means for making an electrical contact attached to the housing means; and a second means for making an electrical contact attached to the housing means on a side opposite the first means for making an electrical contact and in electrical communication with the first means for making and electrical contact.

In accordance with another embodiment of the present invention, a method of forming an electrical and mechanical connection is provided. The method includes: aligning a first connector and a second connector; inserting a key located on one of the connectors into a corresponding slot located on the other connector; sliding a ridge located on one of the connectors into a corresponding groove located on the other connector; compressing a spring probe pin located on one of the connectors against a corresponding spring probe pad located on the other connector; and flexing at least one of a housing having the ridge located on one of the connectors and the corresponding receiver defining the groove located on the other connector.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
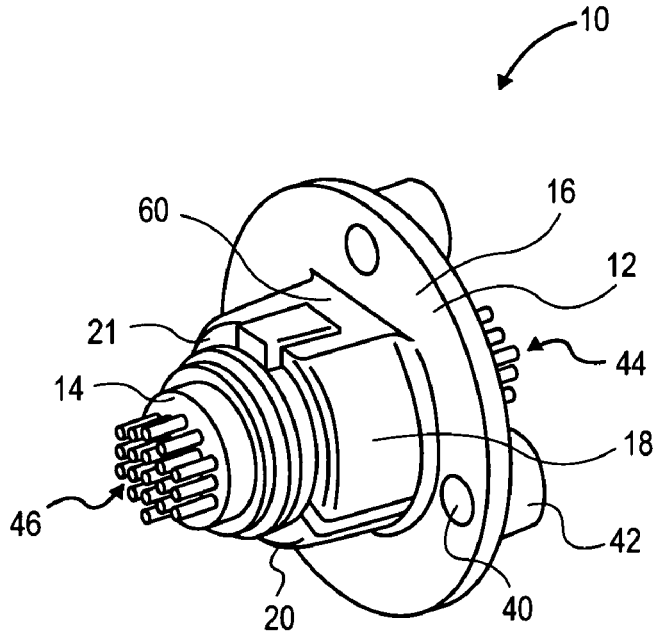
FIG. 1 is a perspective view of a plug connected to a receptacle forming a both mechanical and electrical connection in accordance with a preferred embodiment of the present invention.

The invention will now be described with reference to the drawing figures, in which like reference numerals refer to like parts throughout. An embodiment in accordance with the present invention provides a plug that is configured to both mechanically and electrically connect to a receptacle.

Figure 2:
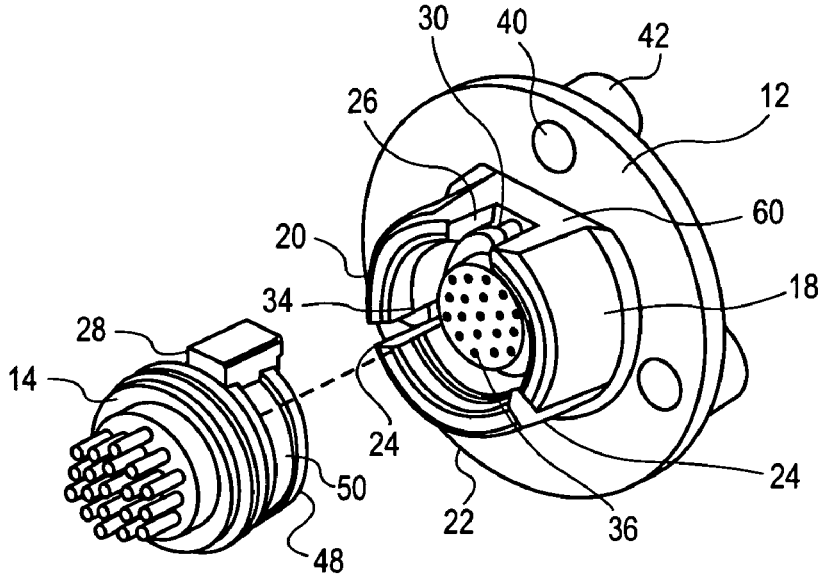
FIG. 2 is a perspective view of the plug approaching the receptacle of FIG. 1.
Figure 3:
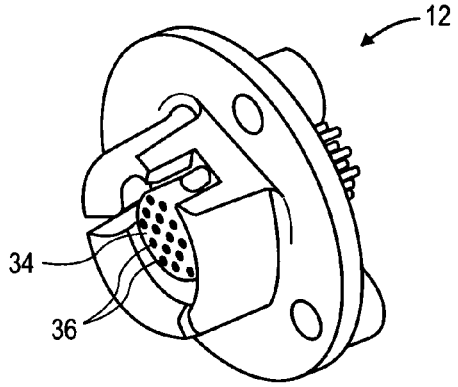
FIG. 3 is a perspective view of a front side the receptacle shown in FIG. 1.
Figure 4:
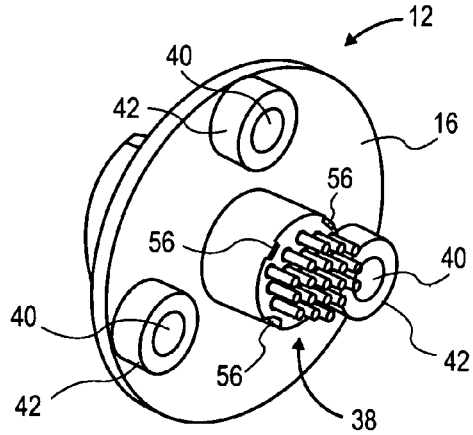
FIG. 4 is a perspective view of the back side of the receptacle shown in FIG. 1.

An embodiment of the present inventive apparatus is illustrated in FIG. 1. FIG. 1 shows a connector system 10. The connector system 10 includes a receptor 12 and a plug 14. The plug 14 is shown inserted into the receptor 12. The receptor 12 includes a housing 16. The housing 16 may be metal or plastic or any other suitable material. As shown in FIG. 2 three receivers 18, 20, 22 are mounted on the housing 16 of the receptor 12. The receivers 18, 20, 22 have a generally circular shape. The receivers 18, 20, 22 are configured to meet with, and receive the plug housing 48.

As shown in FIG. 2, located between the receivers 18, 20, 22 are relief slots 24. A key slot 26 is defined by two of the receivers 18, 20. The key slot 26 is a generally rectangular shape and is configured to receive a corresponding key 28 located on the plug 14. One purpose of the key 28 and key slot 26 is to prevent the plug 14 from entering the receptor 12 at any attitude other than the one with the key 28 fits into the key slot 26. Permitting the plug 14 to only fit in the receptor 12 in one way helps ensure that the electrical contact made between the plug 14 and the receptor 12 is appropriate and the electrical connectors not intended to contact each other do not contact. Inside the key slot 26 is a key hole shaft 30 shown in FIG. 2. The key hole shaft 30 fits into a corresponding hole 32 (see FIG. 5) located within the key 28.

Turning now to FIG. 2, a contact face 34 is located within the area defined by the receivers 18, 20, 22. The contact face 34 has embedded within it contact pads 36. The contact pads 36 contact pins 58 mounted into the plug 14 (see FIG. 5).

The receptor 12 has within the housing 16 bolt holes 40. The bolt holes 40 permit the receptor 12 to be mounted on to a structure such as a terminal structure for a nurse call station. In some embodiments of the invention, self threaded screws will be inserted and turned in the bolt holes 40 to mount the receptor 12 to a terminal housing. Mounted behind the housing 16 are bolt housings 42 which will provide spacing between the housing 16 and the device to which the receptor 12 is mounted.

On the opposite side of the receptor 12 that receives the plug 14, extend printed circuit board contacts 44. In some embodiments the invention, the circuit board contacts 44 may be molded into a plastic housing 16 of the receptor 12.

On the back side of the plug 14 are solder cups 46 which, in some embodiments of the invention, are molded into a plastic housing 48 of the plug 14. The solder cups 46 are electrically connected to wires within a cable that extends to a patient's room in a nurse call system. The plug 14 terminates the cable and permits the cable to be connected to a terminal.

According to some embodiments of the invention, the plug 14 mates with the receptor 12 to form a mechanical connection 10 (see FIG. 1) that resists disconnecting when subjected to a force pulling the plug 14 away from the receptor 12 until the force reaches a predetermined level. Further, once the mechanical connection is broken, it can be reformed and broken again without substantial loss integrity of the connection 10.

Figure 8:
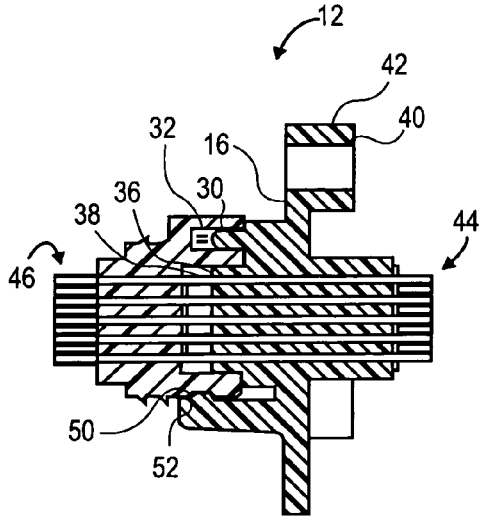
FIG. 8 is a cross section view take along line AA in FIG. 7.
Figure 9:
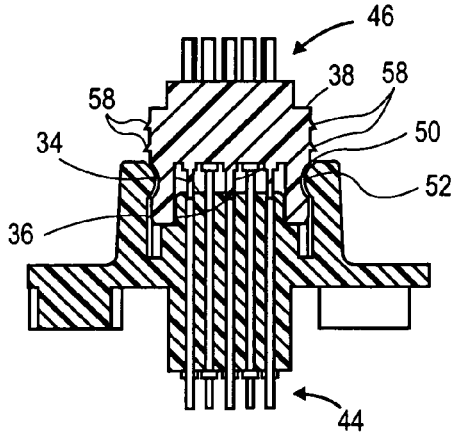
FIG. 9 is a cross section view taken along the line BB in FIG. 7.

In other words, breaking the connection 10 does not normally involve breaking any of the parts of the connectors 12 and 14. For example, a mechanical connection in accordance with the invention can be accomplished by putting a groove 50 into the housing 48 of the plug 14. The groove 50 will contact and connect with a ridge 52 protruding from the receivers 18, 20, 22 as shown in FIGS. 8 and 9.

When the plug 14 is inserted into the receptor 12 the housing 48 of the plug 14 will contact the protruding ridge 52 and push the receivers 18,20,22 and flex them slightly out of the way. To aid in the flexing of the receivers 18 relief slots 24 and 26 are provided. The slots 24 and 26 permit or facilitate the flexing of the receivers 18,20,22 and either embodiments of the invention rather than the receivers 18, 20, 22 flexing the plug housing 48 could flex or in some embodiments flexure could occur in both the receivers 18, 20, 22 and the plug housing 48. Once the groove 50 is in place and aligned with the protruding ridge 52, the receivers 18,20,22 move back to the original position or near the original position and hold the plug 14 in place as shown in FIGS. 8 and 9.

Figure 5:
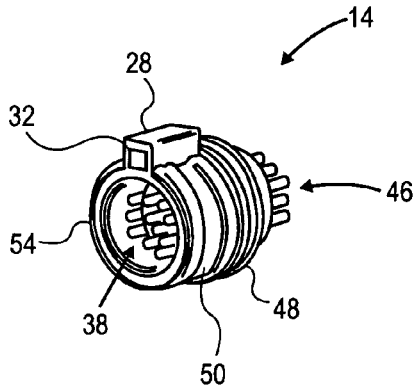
FIG. 5 is a front perspective view of the plug of FIG. 1.
Figure 6:
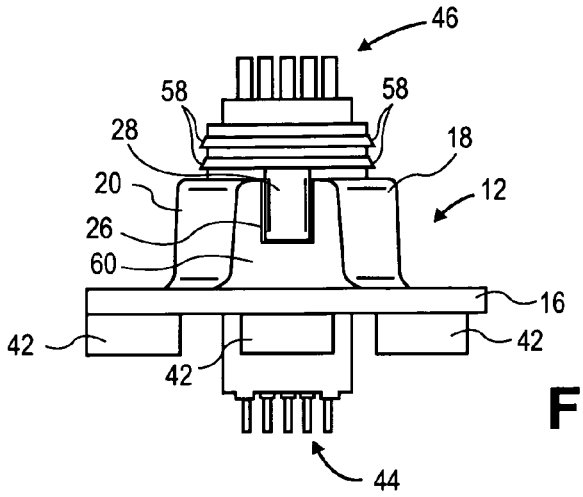
FIG. 6 is a top view of the plug and receptacle of FIG. 1.

According to some embodiments of the invention, the electrical contact between the plug 14 and the receptor 12 is accomplished as follows. As shown in FIG. 5, the plug 14 has pins 38, which in some embodiments of the invention are spring probe pins 38 which are extended in an outmost position by internal springs. The spring probe pins 38 will come in contact with corresponding contacts pads 36 and the spring probe pins 38 will change length slightly as the springs compress due to the close contact with the contact pads 36. In some embodiments of the invention, there are nineteen (19) spring probe pins 38 and nineteen (19) corresponding contact pads 36.

The pins 38 are given protection from an extended portion or pin cover 54 of the housing 48. The extended portion 54 extends beyond the maximum length of the pins 38 long enough to render the plug 14 scoop proof. The term scoop proof refers to the problem of pins 38 or other fragile elements being damaged by being "scooped" when they are protected by an extension on a housing that provides general protection of the pins 38. In some instances, the pins 38 can be damaged by an object having a curved surface. (Often another connector having an extended portion of the housing protecting recessed electrical components.) If the two connectors come together in a skewed manner, there is a potential for the extended housing in one connector could contact the pins 38 on the other connector and bend, break, or otherwise damage them. Scoop proofing the connectors is done by giving the extended portion 54 of the housing 10 sufficient length that a corresponding connector could not scoop deep enough to contact the pins 58.

The contact pads 36 are located to be substantially coplanar with the contact face 34. When the plug 14 mates with the receptor 12 the spring probe pins 38 will contact and butt up against the contact pads 36 as shown in FIGS. 8 and 9. The actual physical contact between the spring probe pins 38 and the contact pads 36 provide the electrical connection between the plug 14 and the receptacle 12. The springs in the spring probe pins 38 assist in ensuring the contact with the contact pads 36.

As illustrated in FIGS. 8 and 9 the spring probe pins 38 directly connect through the housing of the plug to the solder cups 46 of the plug 14. Likewise, the contact pads 36 of the receptor 12 directly connect to the printed circuit board connector leads 44. In preferred embodiments of the invention, there is a one to one correspondence between the spring probe pins 38, the contact pads 36, the printed circuit board receptors 44 and the solder cups 46. In the preferred embodiments of the invention there are nineteen (19) of each of these elements 36, 38, 44 and 46.

Figure 7:
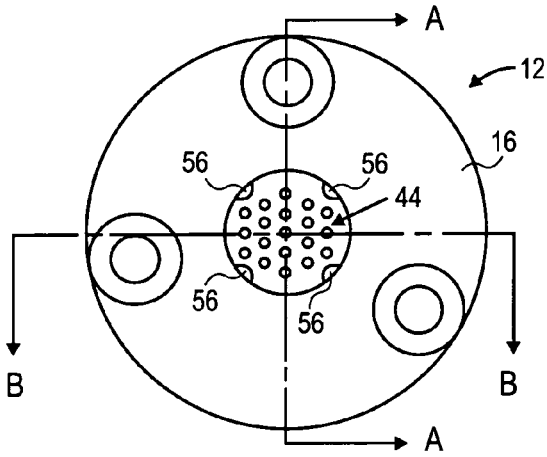
FIG. 7 is a back view of the receptacle of FIG. 1.

In some embodiments of the invention, as shown in FIGS. 7 and 8, the back of the housing 16 has spacers 56 mounted near the printed circuit board leads 44. The spacers 56 permit a gap to exist between the housing 16 and the printed circuit board when the printed circuit board leads 44 are inserted into the printed circuit board.

In some embodiments of the invention, the plug 14 on the plug housing 48 includes grippers 58 as shown in FIGS. 8 and 9. A gripper 58 located on the plug housing 48 and is configured to grip a cable covering that is pushed up and surrounding, at least part, the housing 48. Substantially, in some embodiments of the invention, the receivers 18, 20, 22 substantially form a flat surface 60 on the receptor 12. Further, in some embodiments of the invention, when the key 28 is inserted into the key slot 26, the key 28 helps to define the flat surface 60. In embodiments of the invention where a key hole shaft 30 is configured to fit within the hole 32 in the key 28 the key hole shaft 30 will fit into the key hole 32 and the key 28 as substantially as shown in FIG. 8.

It will be understood that the connectors 14 and 16 and connector systems can be modified from the exemplary embodiment shown and still be in accordance with the invention. For example, features that are shown and described herein as existing on one connector 12 or 14 and having a corresponding feature or the other connector may be reversed as to which connector, the plug 14 or the receptor 12 the feature is located on. Whether the plug 14 or the receptor 12 contains the key, it will be the other connector that contains the key slot 26. Likewise, the key hole shaft 30 and the hole in the key 32 can also be reversed upon which element, the plug 14 or the receptor 12 is found. In addition, the spring probe pins 38 can be carried on the receptor 12 rather than on the plug 14. The protrusion ridge 52 and the corresponding groove can be reversed as to whether they are found on the plug 14 on the receptor 12.

The question of whether the receptor 12 or the plug 14 carries a particular element configured to aid in the mating of the two parts, the plug 14 and the receptor 12, is a design choice that may be made by one skilled in the art after having reviewed this disclosure to meet the specific needs as an individual application.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An electrical connector comprising:

a plug having a housing;

a key attached to the housing, wherein the key is configured to mate with a key slot located on a mating receptor;

a groove running along an outer periphery of the housing and configured to communicate with a plurality of receivers that are located in a circular discontinuous manner on the mating receptor, wherein the plurality of receivers comprise a ridge that mates with the groove;

a first electrical contact attached to the housing; and a second electrical contact attached to the housing on a side opposite the first electrical contact and in electrical communication with the first electrical contact.

2. The electrical connector of claim 1, further comprising a hole defined by the key and configured to mate with a corresponding protrusion in the mating receptor.

3. The electrical connector of claim 1, wherein the first electrical contact is a spring probe pin.

4. The electrical connector of claim 3, further comprising eighteen (18) additional spring probe pins located proximate to the first electrical contact.

5. The electrical connector of claim 1, wherein the second electrical contact is a solder cup.

6. The electrical connector of claim 5, further comprising eighteen (18) additional solder cups located proximate to the second electrical contact.

7. The electrical connector of claim 1, wherein the housing is plastic.

8. The electrical connector of claim 7, wherein at least one of the first and second electrical contact is molded into the housing.

9. The electrical connector of claim 1, wherein the plug is substantially cylindrical in shape.

10. The electrical connector of claim 1, wherein the housing extends beyond the first electrical contact and makes the first electrical contact scoop proof.

11. The electrical connector of claim 1, further comprising a gripping ridge located on the housing.

12. The electrical connector of claim 1, wherein the key has a flat portion and is configured to define along with a receiver on the mating connector a substantially flat surface.

13. The electrical connector of claim 1, wherein the connector is part of a nurse call system.

14. A method of forming an electrical and mechanical connection comprising:

aligning a first connector and a second connector;

inserting a key located on one of the connectors into a corresponding slot located on the other connector;

sliding a ridge located on one of the connectors into a corresponding groove located on the other connector, wherein the ridge protrudes from a plurality of discontinuous receivers;

compressing a spring probe pin located on one of the connectors against a corresponding contact pad located on the other connector; and flexing at least one of a housing having the ridge located on one of the connectors and the corresponding receiver defining the groove located on the other connector.

15. The method of claim 14, further comprising inserting a key slot protrusion located on one of the connectors into a corresponding key hole located on the other connector.

16. The method of claim 14, compressing eighteen (18) other spring probe pins located on one of the connectors into corresponding eighteen (18) contact pads located on the other connector.

17. The method of claim 14, further comprising sending a nurse call signal through at least one of the spring probe pin and the contact pad.

18. The method of claim 14, further comprising sending a patient monitoring signal through at least one of the spring probe pin and the contact pad.

* * * * *